United States Patent [19]

Stanczak

[11] Patent Number: 4,966,174

[45] Date of Patent: Oct. 30, 1990

[54] FINGERNAIL PROTECTOR

[76] Inventor: James J. Stanczak, 1802 East Campobello Dr. #101, Phoenix, Ariz. 85022

[21] Appl. No.: 392,412

[22] Filed: Aug. 11, 1989

[51] Int. Cl.[5] ..... A45D 29/00

[52] U.S. Cl. ..... 132/73; 2/21

[58] Field of Search ..... 132/73, 73.5, 285; 2/21

[56] References Cited

U.S. PATENT DOCUMENTS

| | | | |
|---|---|---|---|
| 1,066,556 | 7/1913 | Tueckmantel | 2/21 |
| 2,179,046 | 11/1939 | Lewis | 2/21 |
| 2,251,551 | 8/1941 | O'Reilly | 2/21 |
| 2,458,709 | 1/1949 | Kayer | 2/21 |
| 2,557,759 | 6/1951 | Pfister | 132/285 |
| 2,591,092 | 4/1952 | Okonski | 132/285 |
| 2,799,282 | 7/1957 | Slack | 132/283 |
| 3,046,561 | 7/1962 | Marinese et al. | 2/21 |

*Primary Examiner*—Gene Mancene
*Assistant Examiner*—Michael Lynch
*Attorney, Agent, or Firm*—Leon Gilden

[57] ABSTRACT

A fingernail protector is set forth utilizing an upper top convex shell formed with an arcuate convex upper surface overlying and pivoted at its forward end to an underlying shell formed with a planar bottom surface. The shells are biased in a normally opened position and include securement means at their entrance portions.

6 Claims, 4 Drawing Sheets

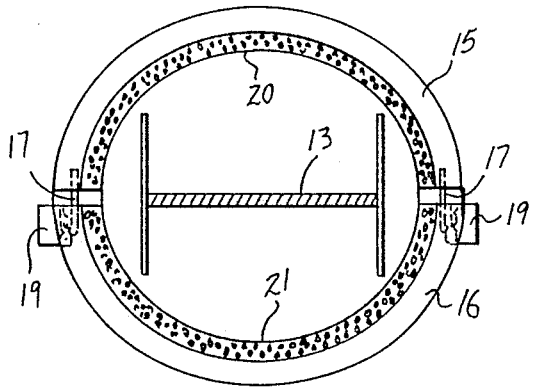
FIG. 3
FIG. 4
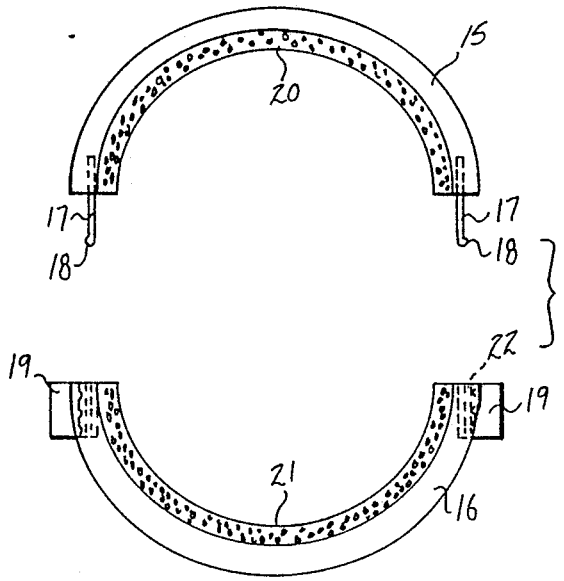
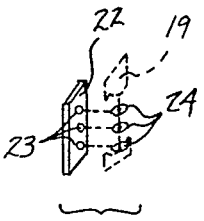
FIG. 4A

FIG 7
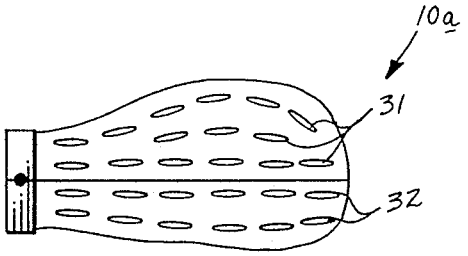
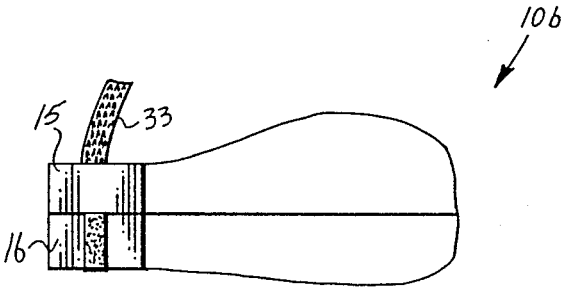
FIG 8

FINGERNAIL PROTECTOR

BACKGROUND OF THE INVENTION

1. Field of the Invention:

The field of invention relates to fingernail protectors, and more particularly pertains to a new and improved fingernail protector apparatus wherein the same utilizes cooperating clamp shell portions to provide an enveloping structure about an associated fingernail for enabling drying and protection of the same.

2. Description of the Prior Art:

The use of fingernail protectors is well known in the prior art. Heretofore fingernail protectors of the prior art have been of limited configuration to effect a drying or a protective function, but have heretofore not provided a plurality of function and purpose as required in contemporary society. Examples of the prior art include U.S. Pat. No. 2,251,551 to O'Reilly providing an upper and lower fingernail protective device with a forward biased pivot hinge and a rear securement band to secure the upper and lower halves together.

U.S. Pat. No. 4,089,066 to Dethman provides a tubular conduit protector pivoted at its side portion thereof for overlying securement of a nail with a rearwardly extending loop to align the cover relatives to the fingernail.

U.S. Pat. No. 2,557,759 to Pfister provides a nail guard of tubular configuration with an overlying extending loop to afford protection to the underlying fingernail.

U.S. Pat. No. 2,458,709 to Kayer provides a rigid fingernail protector with a rearwardly positioned loop and a forwardly positioned hood to overlie a fingernail.

U.S. Pat. No. 2,591,092 to Okonski sets forth a forwardly extending fingernail shroud with a rearwardly positioned finger securement portion utilizing a relatively complex linkage arrangement to secure to the fingernail shroud relative to the finger.

As such, it may be appreciated that there is a continuing need for a new and improved fingernail protector wherein the same addresses both the problems of ease of use and effectiveness in construction, and in this respect, the present invention substantially fulfills this need.

SUMMARY OF THE INVENTION

In the view of the foregoing disadvantages inherent in the known types of fingernail protectors now present in the prior art, the present invention provides a fingernail protector wherein the same utilizes mating shell members to provide a completely enclosed shell about an associated fingernail to afford protection and enable drying of the fingernail therein in a debris-free environment. As such, the general purpose of the present invention, which will be described subsequently in greater detail, is to provide a new and improved fingernail protector which has all the advantages of the prior art fingernail protectors and none of the disadvantages.

To attain this, the present invention includes an overlying convex shell pivotally mounted at its forward end to an underlying shell formed with a planar bottom surface, wherein the shells provide a completely enclosing shell unit about an associated fingernail with a rearwardly oriented latch. The rearwardly oriented latch is positioned exteriorly of the semicircular entrance portions of the upper and lower shells respectively, wherein the upper shells include sponge-like laminates fixedly secured to interior surfaces of the entrance portions to provide a secure fastening of the unit to an associated fingernail. The latch member includes a downwardly extending rod with a spherical lower end receivable within one of a series of openings formed within a latch plate within the lower shell. A release button includes a series of projections to remove the spherical end from within one of the openings of the latch plate. A modification of the instant invention includes upper and lower sponge inserts of a complementary configuration to an interior surface of the respective upper and lower shells to provide enhanced protection to the shell subsequent to a drying. A yet further modification provides for an adherable strip securable of a planar bottom surface of the bottom shell formed with a roughened bottom surface to enable an individual to utilize a shell in the performance of various physical duties, such as typing. A yet further modification provides for completely surrounding apertures formed through the upper and lower shell members and the use of encircling hook and loop fastener strip to secure the shells together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described herein after and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fingernail protector which has all the advantages of the prior art fingernail protectors and none of the disadvantages.

It is another object of the present invention to provide a new and improved fingernail protector which may be easily and efficiently manufactured and marketed.

It is a further object of the present invention to provide a new and improved fingernail protector which is of a durable and reliable construction.

An even further object of the present invention is to provide a new and improved fingernail protector which is susceptible of a low cost of manufactured with regard to both materials and labor, and which accordingly is then susceptible of low prices of sale to the consuming public, thereby making such fingernail protector economically available to the buying public.

Still yet another object of the present invention is to provide a new and improved fingernail protector which provides in the apparatuses and methods of the prior art some of the advantages thereof, while simultaneously overcoming some of the disadvantages normally associated therewith.

Still another object of the present invention is to provide a new and improved fingernail protector wherein the same utilizes mainly securable upper and lower shell members for completely surrounding and encasing a fingernail to enable drying and subsequent protection of the fingernail.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken in elevation of a rear entrance portion of the instant invention in a first position.

FIG. 4 is an orthographic rear end view of the instant invention taken in a second position.

FIG. 4*a* is an isometric diagrammatic illustration of the latch plate and release buttom utilized by the instant invention.

FIG. 7 is an orthographic side view taken in elevation of a further modification of the instant invention.

FIG. 8 is an orthographic view taken in elevation of a yet further modification of the instant invention.

DESCRIPTION OF THE PREFERRED EMBODIMENT

Figure 1:
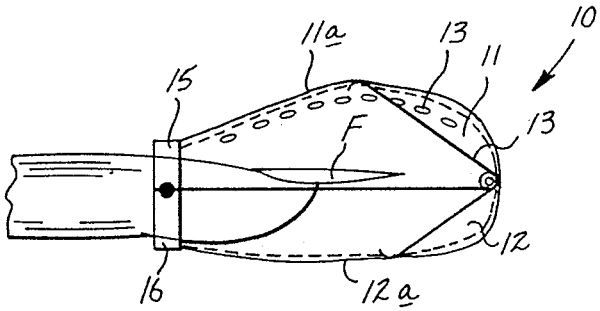
FIG. 1 is an orthographic view taken in elevation of the instant invention in a first closed position.
Figure 2:
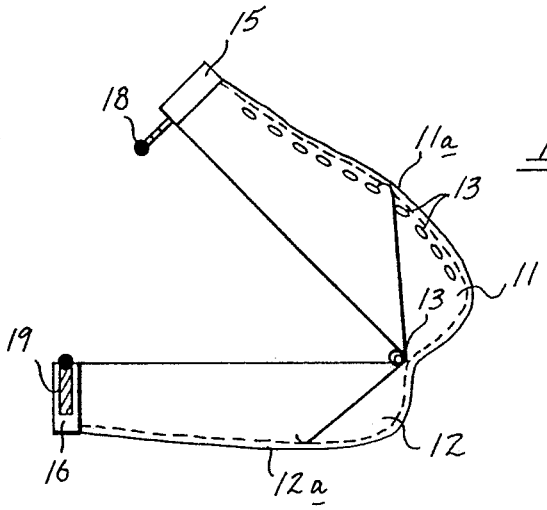
FIG. 2 is an orthographic view taken in elevation of the instant invention in a second open position.

With reference now to the drawings, and in particular to FIGS. 1 to 8 thereof, a new and improved fingernail protector embodying the principles and concepts of the present invention and generally designated by the reference numeral 10 will be described.

More specifically, the fingernail protector apparatus 10 essentially comprises an upper shell 11 formed with a convex top surface 11*c*, wherein the convex top surface extends from a top semi-annular entrance 15 to a forward terminal end of the upper shell 11. The protector 10 further includes a lower shell 12 formed with a planar bottom surface 12*a*, wherein the bottom surface 12*a* is coextensively formed from a bottom semi-annular entrance 16 to a forwardmost terminal end. The forwardmost terminal ends of the upper and lower shells 11 and 12 respectively are pivotally mounted together with a coil spring 14 normally biasing the upper and lower shells apart in a second opened position, as opposed to a first closed position, as illustrated in FIG. 1. Optional apertures 13 are formed through the convex top surface 11*c* of the upper shell to effect air circulation therewithin to enhance drying, but such apertures are optional and may be deleted to prevent contamination of the interior of the shell when in a first position preventing admission of dust and the like therewithin.

A rigid latch rod 17 is orthogonally secured and downwardly extending from the top semi-annular entrance 15, wherein each latch rod 17 is formed at its terminal lower end with a spherical terminal end 18 to be received within one of a series of aligned latch openings 23 formed within a latch plate release button 19 reciprocatably mounted and diametrically opposed relative to one another on either side of the bottom entrance 16 includes a series of release projections 24 aligned with the latch openings 23 whereupon inward depressing of the release button 19, as illustrated in FIG. 4*a* for example, effect removal of the spherical lower ends 18 of the latch rods relative to the latch plates 22.

Each top and bottom semi-annular entrance 15 and 16 respectively includes a respective top and bottom sponge laminate 20 and 21 respectively, as illustrated in FIGS. 3 and 4 for example, to accomodate various finger cross-sectional configurations therewithin and provide a tight sealing arrangement of the finger relative to the protector when in a closed position. It should be also noted that the upper and lower shells 12 confront in edge to edge relationship to provide a completely enclosing and encircling pivoted nail protector to minimize intrusion of debris therewithin.

Figure 5:
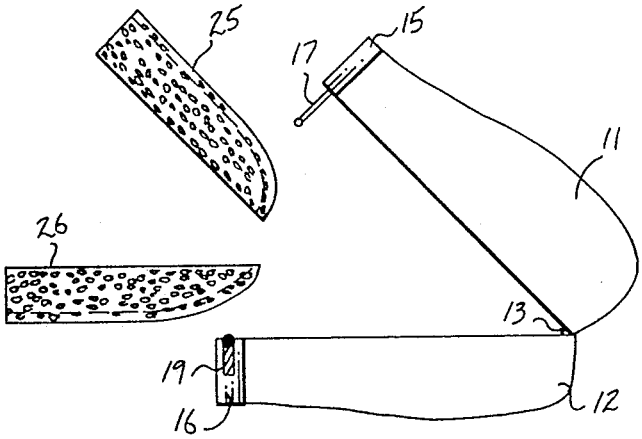
FIG. 5 is an orthographic view taken in elevation illustrating the use of sponge-like inserts by the instant invention.

Attention to FIG. 5 illustrates the use of a respective top and bottom sponge insert 25 and 26 receivable within the respective upper and lower shells 11 and 12 respectively. The top and bottom inserts are of a complementary external configuration to the respective internal configurations of the upper and lower shells. The inserts are utilized subsequent to a partial drying of a fingernail coated with a polish and the like to enable the included finger "F" to be more securely positioned within the nail protector when closed to enable an individual to utilize the fingernail protector 10 in daily manual chores. The top and bottom inserts 25 and 26 are also of a shell-like configuration to receive the finger therewithin in a secure manner and effect further drying and hardening of the polish subsequent to an initial drying.

Figure 6:
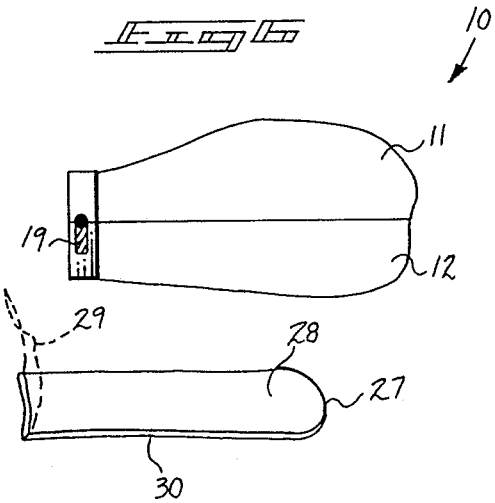
FIG. 6 is an orthographic side view of the instant invention and its association with an adherable strip.

FIG. 6 is illustrative of a flexible securement strip 27 provided with an adhesive top surface with a peel-away covering strip 29 to enable adherence of the top surface 28 to the planar bottom surface 12*a* of the fingernail protector. The securement strip 27 further includes as roughened bottom surface 30 to provide additional frictional engagement of the protector 10 in use in certain manual chores, such as typing and the like.

FIG. 7 is illustrative of a modification of the fingernail protector 10*a* formed with an encircling series of top apertures 31 and an encircling series of bottom apertures 32 to effect enhanced air flow into the confines of the fingernail protector 10.

FIG. 8 is illustrative of a further fingernail protector **10*b* utilizing a single hook and loop fastener strip 33 of a length greater than that defined by the external diameter of the top and bottom annular entrances 15 and 16, wherein the hook and loop fastener strip 33 enables securement of the fingernail protector 10*b*** in position about an associated finger and fingernail.

As to the manner of usage and operation of the instant invention, the same should be apparent from the above disclosure, and accordingly no further discussion relative to the same manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A fingernail protector comprising, an upper shell formed with a convex upper surface with the upper surface coextensively formed with the shells and including a semi-annular upper entrance opening.

and a lower shell formed with a planar bottom surface and including a semi-annular lower entrance opening, and the upper and lower shells defining a completely enclosing unit when secured about an individual's finger in a closed first position, and the upper and lower entrance openings aligned to form a continuous annular opening, and a latch means for selective securement of the upper and lower shells together, and the upper and lower shells pivotally secured together at their forward ends including a spring to bias the upper and lower shells in a spaced second position, and wherein the latch means includes a plurality of rigid latch rods mounted to the upper shell diametrically opposed to one another on opposite sides of the upper entrance opening and receivable within the lower shell about the lower entrance opening, and wherein the latch means further includes a latch plate formed with a series of aligned openings positioned within the lower entrance opening in alignment with the rigid rods to secure the rigid rods relative to the respective latch plate openings, each of the plurality of rigid rods is formed with a spherical lower terminal end receivable within one of the latch openings formed within the latch plate, and further including a release button secured on opposite sides of the lower entrance and the release button including a series of projections, each of the projections aligned with the respective latch openings wherein the release button ejects the spherical end of the rigid latch rod from a respective latch opening when the release projections are directed into the latch openings.

2. A fingernail protector as set forth in claim 1 wherein a semi-annular upper sponge laminate is secured interiorly of the upper entrance and a semi-annular sponge laminate is secure interiorly of the lower opening to secure a finger positioned within the upper and lower openings.

3. A fingernail protector as set forth in claim 2 futher including an upper and lower sponge insert of an external configuration complementary to an internal configuration defined by the upper shell and the lower insert formed with an external configuration complementary to an internal configuration defined by the lower shell, and the upper and lower inserts are removably mounted within the upper and lower shells.

4. A fingernail protector as set forth in claim 3 further including a flexible securement strip, wherein the securement strip includes an adhesive top surface, the adhesive top surface includes a peel-away covering strip to expose an adhesive on the upper surface of the strip, and wherein the flexible strip further includes a roughened bottom surface to enhance frictional engagement of the bottom surface of the strip when the strip is secured to the planar bottom surface of the lower shell.

5. A fingernail protector as set forth in claim 4 wherein the upper shell and the lower shell each include plural rows of apertures completely surrounding the upper and lower shells to enhance air circulation within the shells.

6. A fingernail protector as set forth in claim 5 further including a continuous hook and loop fastener strip of a length greater than a circumference defined by external surfaces of the upper and lower entrance openings, wherein the hook and loop fastener strip is securable onto itself to secure the upper and lower shells together when secured about the external surfaces of the upper and lower entrance openings.

* * * * *